US007757335B1

(12) United States Patent
Servidio

(10) Patent No.: US 7,757,335 B1
(45) Date of Patent: Jul. 20, 2010

(54) TROWEL

(76) Inventor: Philip Servidio, 5132 Little Beth Dr. South, Boynton Beach, FL (US) 33437

( * ) Notice: Subject to any disclaimer, the term of this patent is extended or adjusted under 35 U.S.C. 154(b) by 1023 days.

(21) Appl. No.: 11/416,975

(22) Filed: May 3, 2006

(51) Int. Cl.
*B05C 17/10* (2006.01)
*E01C 19/12* (2006.01)

(52) U.S. Cl. ..... 15/235.4; 15/235.6

(58) Field of Classification Search ..... 15/235.4, 15/235.5, 235.6, 235.7, 236.01; D8/45; 294/3.5
See application file for complete search history.

(56) References Cited

U.S. PATENT DOCUMENTS

| | | | | |
|---|---|---|---|---|
| 1,575,318 | A | 3/1926 | Cowan | |
| 2,395,186 | A | 2/1946 | Jones | |
| 2,561,521 | A | 7/1951 | Lent | |
| 3,023,444 | A | 3/1962 | Tims | |
| 3,166,776 | A | 1/1965 | Selck | |
| 3,346,905 | A | 10/1967 | Scarpelli | |
| 4,254,980 | A | 3/1981 | Anderson | |
| 4,901,801 | A | 2/1990 | Popivalo | |
| 5,231,729 | A | 8/1993 | Rose | |
| 6,145,204 | A * | 11/2000 | Cash | 30/322 |
| 6,178,586 | B1 | 1/2001 | Jafarmadar | |
| 6,237,226 | B1 * | 5/2001 | Huang | 30/322 |
| D498,995 | S | 11/2004 | Whitlock | |
| D548,544 | S * | 8/2007 | Simpson et al. | D7/653 |

* cited by examiner

*Primary Examiner*—Shay L Karls
(74) *Attorney, Agent, or Firm*—Gold & Rizvi, P.A.; Glenn E. Gold; H. John Rizvi

(57) ABSTRACT

An improved trowel for facilitating the production of air pockets in a layer of mortar mix applied to a substrate for receiving marble-flooring pieces thereon. The trowel comprises a handle and an elongated blade joined together by a shank. The shape of the blade gradually narrows to a distal end that includes a plurality of tips separated by one or more V-shaped notch or notches. In various versions of the invention, the number of tips may vary and the tips may be flat or pointed. The V-shaped notch or notches may vary in depth.

7 Claims, 2 Drawing Sheets

TROWEL

BACKGROUND OF THE INVENTION

1. Field of the Invention

The present invention generally relates to hand trowels and more particularly to a hand trowel having a novel design to create a base depth during the installation of marble, granite and onyx flooring.

2. Description of the Prior Art

Marble, granite and onyx flooring tiles are typically laid on a substrate in side-by-side relation, leaving uniform spaces between tiles for grout lines. The flooring pieces are affixed to the substrate with an adhesive material commonly referred to as "thinset," which is spread onto the substrate or sub floor. Then a layer of mortar mix is dispersed in a certain thickness to allow leveling of the floor. The mortar mix is prepared to a consistency that is workable but capable of standing in shape, supporting the different marble size and thickness throughout.

In order to install a run of marble, granite or onyx flooring, the mud bed, or mortar mix, is dispersed over the adhesive that was previously spread onto the sub floor, in a layer having variable thickness for leveling or pitching the floor. When the flooring material is pressed onto the layer of mortar bed material, the material evenly supports the flooring material, which has also been spread with the adhesive, forming a strong bond with the sub floor to allow the mud to disperse. This allows the excess mortar mix to spread without compromising the flooring material. Additionally, the raised level of mortar allows the installer to place a flooring piece in contact with the mortar bed and then mallet the flooring piece down to the degree necessary to achieve a level installation relative to the other previously installed flooring pieces, or pitched to the correct degree for patio or shower flooring.

Various techniques are used to spread the surface of the mortar prior to pressing the flooring pieces into place. The conventional technique for preparing the surface of the mortar bed is performed by hoeing the mortar toward the installer with a conventional margin trowel, so as to form air pockets resembling an egg carton within the thickness, of the mortar mix. This technique also enables the raising and lowering of the height of the layer of adhesive, and allows the flooring material to be installed in contact with the mud bed and tapped into place with the mallet. This technique is frequently used during the installation of marble, granite and onyx flooring and is typically performed with a conventional margin trowel. The mortar spreads by exploding into the air pockets, filling the space as the flooring is pounded down with a mallet. This technique is frequently used during the installation of marble, granite and onyx flooring, and is typically performed with the use of a conventional prior art margin trowel, as shown in FIG. 1. Conventionally, the trowel has a handle and a rectangular blade, which is typically 2 inches wide and 5+ inches in length. The installer uses the margin trowel to work the mortar bed in order to form air pockets. Each draw stroke of the trowel pulls a single furrow in the layer of the mortar bed to form egg carton shaped pockets. There is a need for a new type of trowel that can hoe multiple furrows with each stroke, to increase the efficiency of the process for creating an ideal height/depth of mortar during the installation of marble flooring.

SUMMARY OF THE INVENTION

The present invention is directed to an improved trowel designed for increasing the efficiency of hand working a mortar mix thickness, to produce air pockets in an egg carton style layer of mortar conforming to a certain height of the sub floor. The trowel includes a handle and an elongated slotted blade, securely joined together by a shank with a wooden or rubber handle. The blade has a gradually narrowing shape defined by edges extending to a distal end. The distal end is provided with a plurality of tips, which are spaced apart and separated by V-shaped notches.

The tips are intended for raking through the mortar mix, toward the installer, to prepare the surface in multiple furrows instead of a single furrow. Preferably, the blade is constructed having two, three or four tips. The tips may be defined by a pair of edges converging at a point, wherein the edges converge at an acute angle. Alternatively, the tips may be defined by a pair of edges terminating at a flat, in which case the flat preferably has a length in the range of about 0.5 inches (1.27 cm) to 1.0 inch. (2.54 cm), and preferably about 0.875 inches (2.2 cm). Furthermore, combinations of tips of varying shapes and widths may be combined in the same trowel, depending on the consistency of the mortar mix to be worked.

In addition, the V-shaped notches may be provided in varying sizes to accommodate the characteristics of differing adhesive materials or the installer's preferences. The V-shaped notches preferably vary from a depth of approximately 1.5 to 7.0 inches (3.8 to 17.75 cm) or a depth of from approximately 2% to 90% of the length of the blade.

It is an object of the present invention to provide an improved trowel that increases the efficiency of each stroke, when the trowel is manually worked in a layer of adhesive, so as to increase the production of air pockets with each stroke of the trowel.

It is a further object of the invention to provide an improved trowel that increases the efficiency of each stroke, when the trowel is manually worked in a layer of mortar mix, by presenting a plurality of tips having varied shapes specifically suited to the consistency of the mortar bed.

It is a further object of the present invention to provide an improved trowel that increases the efficiency of each stroke, when the trowel is manually worked in a layer of adhesive, by providing V-shaped notches of varying depths specifically suited to the consistency of the mortar bed.

These and other objects, features and advantages of the present invention will become more readily apparent from the attached drawings and the detailed description of the preferred embodiments, which follow.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

Shown throughout the drawings, the present invention is generally directed to an improved trowel for improving the efficiency of the process of manually working mortar mix in preparation for the installation of marble, granite and onyx flooring. The trowel of the present invention, as shown in various embodiments in FIGS. 2-4, is particularly suited for the work of preparing the surface of a layer of mortar to produce air pockets in the mortar mix material.

The trowel of the present invention includes a handle 15 and a blade 20*a*-20*c*, joined by a shank 25. It is preferred that the handle 15 be formed of rigid material and have a generally cylindrical shape suitable for grasping, as shown in FIGS. 2-4. Wood is the preferred material for the handle 15, but other materials, such as metal surrounded by high strength rubber, may be used. The shank 25 is preferably formed of metal and has a tang (not shown) extending into a bore provided in the handle 15. The tang is securely fixed in the bore, preferably by being wedged into position and glued. It is preferred that the shank 25 have an end opposite the tang, which is securely fixed to the blade 20*a*-20*c* by fastening means, such as by welding or screwing, such that the fastening means lie flush with the blade 20*a*-20*c* on the surface opposite the shank 25. It is preferred that the shank 25 be provided with a curved portion between the handle 15 and the blade 20*a*-20*c* to displace the handle 15 from the plane of the blade 20*a*-20*c*, so that a user may conveniently introduce the blade 20*a*-20*c* to a layer of mortar without contacting the mortar with the handle 15.

Figure 1:
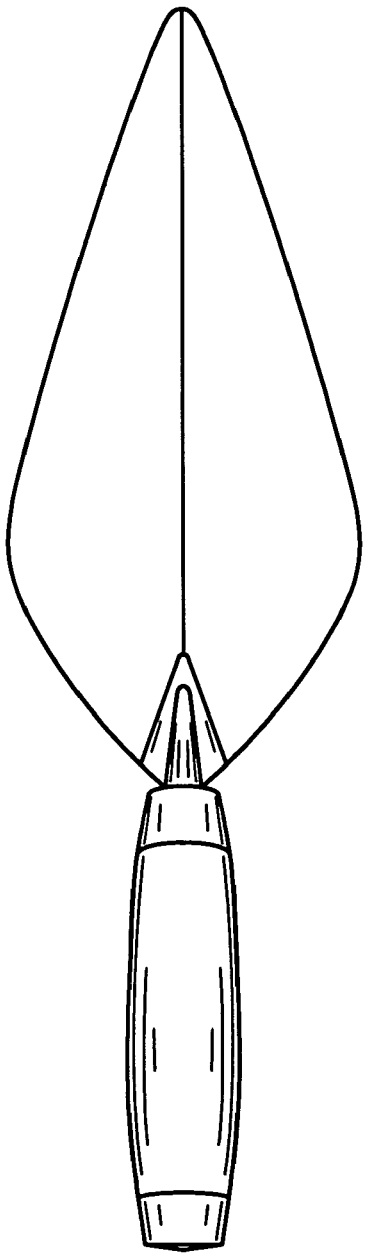
FIG. 1 Prior Art
FIG. 1 is a plan view of a representative conventional trowel of the prior art.

The blade 20*a*-20*c* is preferably of elongated shape, formed of metal selected to have resilient flexibility with some stiffness and a thickness of approximately 1/64 inch (0.04 cm). Metal used for a conventional trowel, of the prior art, as shown in FIG. 1, is suitable for the trowel of the present invention. It will be appreciated by those skilled in the art that a trowel blade having a thickness of approximately 1/64 inch provides an appropriate spacer for gauging the correct spacing for marble flooring tiles.

Figure 2:
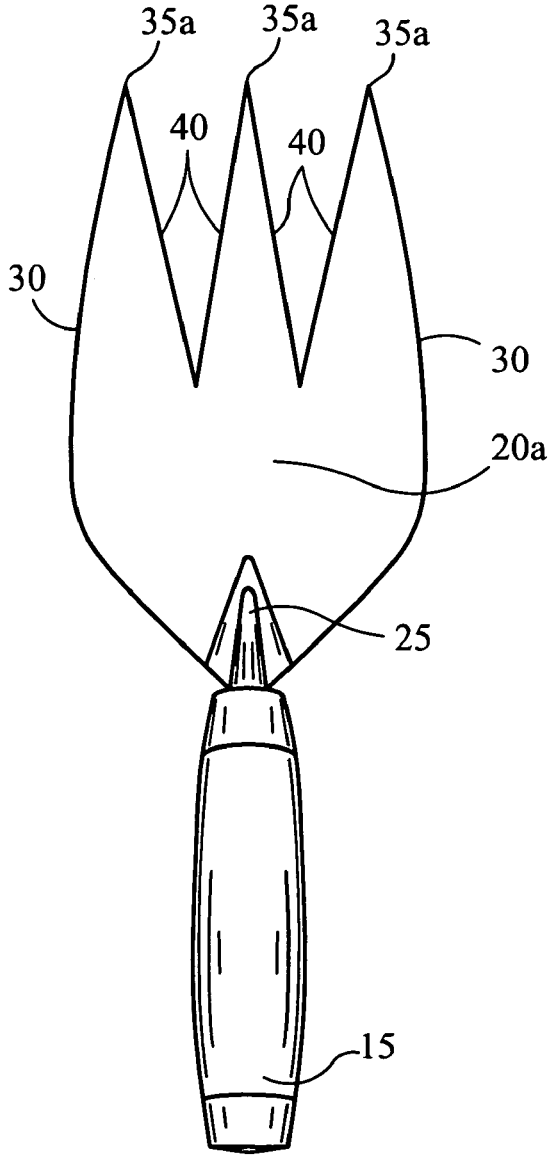
FIG. 2 is a plan view of a trowel of the present invention having three pointed tips and V-shaped notches having a depth of approximately fifty percent of the blade length.
Figure 3:
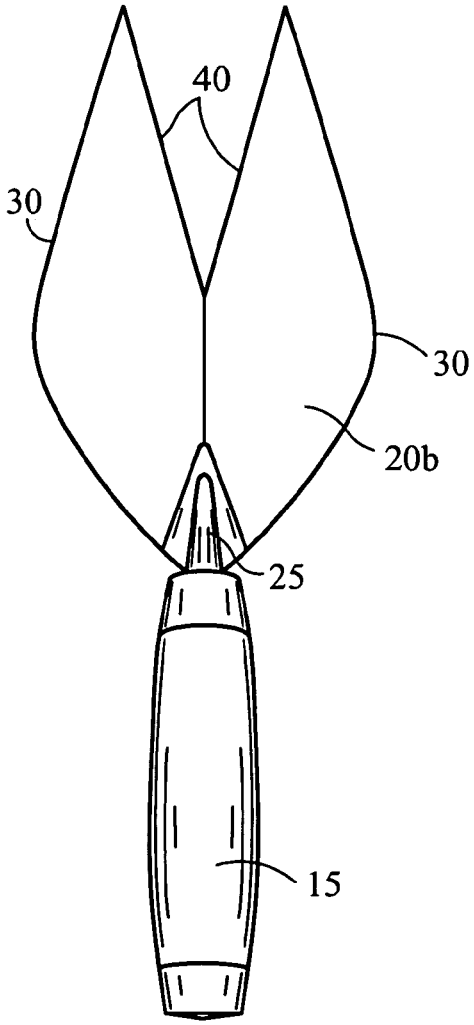
FIG. 3 is a plan view of a trowel of the present invention having two pointed tips and V-shaped notches having a depth of approximately fifty percent of the blade length.
Figure 4:
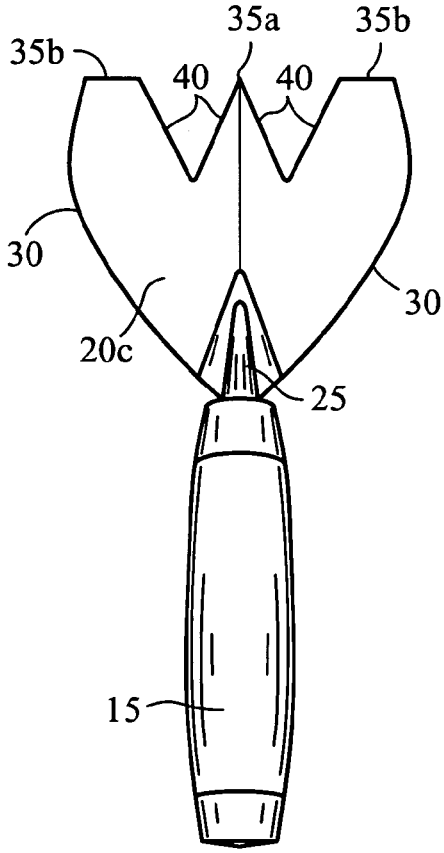
FIG. 4 is a plan view of a trowel of the present invention having one pointed tip, two flat tips and V-shaped notches having a depth of approximately thirty percent of the blade length.

The blade 20*a*-20*c* has a gradually narrowing shape, defined by edges 30, as shown in FIGS. 2-4, extending to a distal end. The distal end is provided with a plurality of tips 35*a*-*b* adapted for working a layer of mortar mix material. The tips 35*a*-*b* are spaced apart and separated by V-shaped notches 40. The present invention contemplates a number of versions having different designs of blades 20*a*-20*c*. A version of the invention is depicted in FIG. 2 having a blade 20*a* with three tips 35*a*, each narrowing, at an acute angle, to a point. A version of the invention is depicted in FIG. 3 having a blade 20*b* with two tips 35*a*, each narrowing, at an acute angle, to a point. A version of the invention is depicted in FIG. 4 having a blade 20*c* with three tips 35*a*-*b*, two of which tips 35*b* narrow to a flat, and a central tip 35*a*, which narrows to a point.

In use, a flooring installer must apply a layer of thinset adhesive to a substrate, followed by a mortar mix, followed by thinset adhesive spread onto flooring material, such as marble, granite or onyx, to be laid in side-by-side relation. The flooring pieces must be aligned in a uniform pattern, leveled relative to each other, and spaced apart evenly to provide uniform grout lines. After laying the flooring pieces, the adhesive is allowed to cure, leaving the flooring pieces firmly affixed to the substrate. When laying marble pieces, it is conventional practice to space the flooring pieces 1/64 inch (0.04 cm) apart. It is also conventional to increase or decrease the height of the layer of mortar mix by disrupting the surface of the mortar bed to form air pockets. The installer works the mortar material in a continuous hoeing motion known to those skilled in the art. With the hoeing motion, each of the plurality of tips 35*a*-*b*, of the trowel of the present invention, rakes a furrow in the mortar mix material, turning the mix to trap air and form the desired light air pockets. The installer may manipulate the trowel to control the movement of mortar mix along the edges 30 and along the V-shaped notches 40, to simultaneously plow multiple furrows and produce egg carton like pockets in the layer of mortar mix.

Mortar mix materials vary in their workability and it is contemplated that the present invention may be provided in different versions to best accommodate varying consistencies of mortar mix. The V-shaped notches 40 preferably have a depth ranging from approximately 1.5 to 7.0 inches (3.8 to 17.75 cm). With regard to the length of the blade 20*a*-20*c*, it is preferred that the V-shaped notches extend approximately in the range of 2% to 90% of the length of the blade 20*a*-20*c*. Generally, increasing the number of tips 35*a*-*b* increases the efficiency of the trowel by allowing a corresponding number of furrows to be hoed by each of the tips 35*a*-*b*. However, for a given consistency of mortar mix material, a sufficient depth of V-shaped notches 40 is required to successfully turn the mortar mix and produce the air pockets. The number of tips 35*a*-*b* is limited by the overall width of the blade 20*a*-*c*. A blade 20*a* having three tips 35*a* is shown in FIG. 2, and a blade 20*b* having two tips 35*a* is shown in FIG. 3. For a less viscous mortar mix material, the trowel may have V-shaped notches 40 of less depth, as shown in FIG. 4, which depicts a trowel with a shorter blade 20*c* and three tips 35*a*-*b*.

Furthermore, varying consistencies of mortar mix material may be worked with trowels having tips 35*a*-*b* of different shape. FIGS. 2 and 3 depict tips 35*a* that narrow to a point. FIG. 4 depicts three tips 35*a*-*b*, two of which tips 35*b* narrow to a flat, and one of which tips 35*a* narrows to a point. Other combinations of number and type of tips 35*a*-*b* and depth of V-shaped notches 40 not specifically shown in the drawings are also considered to be within the scope of the invention.

While the preferred embodiments of the invention have been described above, it will be recognized and understood that various modifications can be made in the invention and the appended claims are intended to cover all such modifications which may fall within the spirit and scope of the invention.

What is claimed is:

1. A trowel for spreading a quantity of a mortar mixture, comprising:

a handle and an elongated blade joined together by a shank;

said blade constructed from a single uniformly thick sheet of metal having upper and lower surfaces terminating at a contiguous perimeter edge joining the upper and lower surfaces, such that a volume of mortar mixture disposed upon the upper surface can slide off of the upper surface and around the perimeter edge in a completely unimpeded fashion;

said blade further defined by a broad area adjacent to the handle that is void of any passages having a size enabling the mortar mixture to pass directly through the blade;

said blade having a geometry gradually narrowing from said broad area toward a distal end thereof;

a crease formed within said blade, said crease located parallel to and substantially along a longitudinal axis of the handle, and terminating about a continuous perimeter edge;

said blade having a gradually narrowing shape defined by edges extending to a distal end;

said distal end having a plurality of tips;

said tips being spaced apart and separated by at least one V-shaped notch provided in said distal end;

whereby said trowel may be manually manipulated to control the movement of said mortar mix material about said tips and along said edges and said at least one V-shaped notch to produce air pockets in said mortar mix.

2. A trowel as recited in claim 1, wherein:

said plurality of tips number from two tips to approximately four tips; and each of said tips narrows to a point.

3. A trowel as recited in claim 2 wherein, said at least one V-shaped notch has a depth in at least one range selected from a group of ranges consisting of:

(a) a range of 1.5 to 7.0 inches (3.8 to 17.75 cm), and (b) a range of 2% to 90% of the length of said blade.

4. A trowel as recited in claim 1, wherein:

said plurality of tips number from two tips to approximately four tips; and each of said tips narrows to a flat.

5. A trowel as recited in claim 4 wherein, said at least one V-shaped notch has a depth in at least one range selected from a group of ranges consisting of:

(a) a range of 1.5 to 5.0 inches (3.8 to 12.7 cm), and (b) a range of 2% to 90% of the length of said blade.

6. A trowel as recited in claim 4, wherein said at least one V-shaped notch has a depth of approximately 1.5 inches (3.8 cm).

7. A trowel as recited in claim 4, wherein said at least one V-shaped notch has a depth of approximately five inches (12.7 cm).

* * * * *